United States Patent [19]

Escallon

[11] Patent Number: 4,582,718

[45] Date of Patent: Apr. 15, 1986

[54] METHOD AND APPARATUS FOR DEPOSITING NONCONDUCTIVE MATERIAL ONTO CONDUCTIVE FILAMENTS

[75] Inventor: Eduardo C. Escallon, Elwood, Ind.

[73] Assignee: Terronics Development Corporation, Elwood, Ind.

[21] Appl. No.: 773,777

[22] Filed: Sep. 9, 1985

[51] Int. Cl.[4] ..... B05D 4/06

[52] U.S. Cl. ..... 427/32; 427/27; 427/117; 118/627; 118/629; 118/634

[58] Field of Search ..... 427/27, 32, 117; 118/627, 629, 634

[56] References Cited

U.S. PATENT DOCUMENTS

| | | | |
|---|---|---|---|
| 3,019,126 | 1/1962 | Bartholomew . | |
| 3,726,701 | 4/1973 | Nishikawa et al. . | |
| 3,841,264 | 10/1974 | Masuda . | |
| 4,022,933 | 5/1977 | Lee . | |
| 4,073,966 | 2/1978 | Scholes | 427/32 |
| 4,188,413 | 2/1980 | Lupinski et al. . | |
| 4,223,047 | 9/1980 | Pappert et al. . | |
| 4,539,219 | 9/1985 | Yamanishi | 427/32 |

FOREIGN PATENT DOCUMENTS 754478 8/1956 United Kingdom .

*Primary Examiner*—Richard Bueker

*Attorney, Agent, or Firm*—Woodard, Weikart, Emhardt & Naughton

[57] ABSTRACT

An apparatus and method is detailed for the application of non-conductive material, generally of a powder or fine fiber form from bulk storage onto a conductive filament or plurality of filaments. A series of vibrating troughs are used to store, convey, unpack and load particulate material at a controllable rate into a gas stream traversing a converging-diverging nozzle. High aerodynamic shear in the nozzle reduces the material's size. Divergent nozzle exit geometry slows the material to speeds where electrostatic forces can predominate, as the material is injected upwardly into a chamber fitted with a cascade of conical forms. Each cone is electrified about its circumference in one or more locations, with respect to a centrally located upward moving filament. Conventional electrostatic charging and deposition on the filament is augmented by the convergent geometry of the cones. Excess material falls on the outside of the cones, and eventually downward to a recovery area. An exhaust system provides vertical velocity augmentation to the particulate cloud, plus a clean exit of the filament. Single, multiple and cabled filaments can be coated in a single apparatus.

11 Claims, 3 Drawing Figures

METHOD AND APPARATUS FOR DEPOSITING NONCONDUCTIVE MATERIAL ONTO CONDUCTIVE FILAMENTS

BACKGROUND OF THE INVENTION

The present invention relates generally to the field of electrostatic deposition of fine non-conductive particles onto a conductive substrate, and more particularly to such deposition onto a moving elongate filament on a high speed continuous basis.

Typically, filaments such as wires are coated with solvent borne organic materials for decorative or functional purposes. Apparatus for this application are described in the literature, a typical arrangement being described in U.S. Pat. No. 4,022,933. The use of solvents in these coating systems poses two difficulties. One is the organic emissions which have to be incinerated or catalytically oxidized to comply with emissions standards. The other is the cost of the solvents lost during the process.

The above referenced patent describes a system for coating wire using high solids chemistry in which the percent of solvent usage is reduced by perhaps as much as one-half over prior technology. However, such high solids coatings tend to have rheology problems during application due to their highly viscous state. Preheating of the coating material is generally required prior to application. Even so, the high viscosity can result in bare spots or misses in coverage of the substrate, and in another defect known as candle waxing or roping which is a longitudinally occurring radial variation in coating thickness.

An alternative approach to coating wire using powder chemistries offers benefits in many areas. Powder coating involves virtually no solvent, so emission standards can be met without expensive afterburners. Additionally, powder coatings can be formulated with higher molecular weights than liquid coatings which helps to produce tougher coatings, with generally greater resistance to environmental deterioration. Furthermore, if electrostatic application of the powder is used, bare spots and local irregularities, such as the candle waxing, can be minimized. U.S. Pat. No. 3,019,126 details both an electrostatic and non-electrostatic means for coating wire, with a fluidized bed as the central element.

SUMMARY OF THE INVENTION

A general summary of the nature of the present invention as well as some of its objects, advantages and uses is set forth briefly below. It should be understood, however, that this summary is not a comprehensive definition of the scope of the invention and is not intended as a limitation thereof.

The basic principle behind the present invention is the proposition, known in the art, that a conductive filament can be coated by passing it through a dispersion of fine particles in the presence of an electrostatic field, thereby causing the particles to become charged and drawn to the conductive filament where they adhere. The conductive filament with adhered particles can then be heated to fuse the particles into a smooth continuous coating.

One aspect of the present invention contemplates coating the conductive filament in a vertical orientation; hence, no compensations have to be made for gravitational effects during either the application of the powder, or the melt to liquid phase occurring in the early portions of the curing operation.

Another aspect of the invention involves a plurality of hollow cones stacked vertically in spaced relationship, with each of the cones converging inwardly from bottom to top. The wire passes vertically up through the cones which are fitted on their interior surfaces with high potential corona generating electrodes. Powder is injected upwardly into the chamber formed within the cones. As the powder rises through the chamber, it is directed radially inwardly toward the filament under the combined influence of the electric field impressed between the electrodes and the filament and an inward velocity vector caused by the convergence of the boundary of the chamber as defined by the interior surfaces of the cones. The upward flow of powder causes an inward flow of air to be drawn through the spaces between the cones, thereby contributing toward the radially inward acceleration of the powder. Overspray or undeposited powder tends to exit between the cones and accumulate on the exterior surfaces thereof where it is periodically shed without danger of being deposited on the filament.

Yet another aspect of the present invention involves particle size reduction of the powder prior to injection into the coating chamber. The powder, carried by a jet of air, is passed through a converging-diverging nozzle which shears agglomerated particles into smaller sized particles just prior to their entry into the deposition zone. Consequently, much thinner coatings are typically achieved. Typical powder coatings are applied in thickness of 0.8 mil and up. The present invention is capable of applying coatings as thin as 0.2 mils. Another aspect which contributes to particle size reduction is the use of vibrating troughs for delivering the bulk powder to the nozzle.

One object of the present invention is to apply, by means of electrostatics, a selected thickness of fine, non-conductive particles or short fibers onto a moving conductive filament or a plurality of filaments in a very uniform manner, at high speed, and with high deposition efficiency.

Other objects and advantages of the present invention will become apparent from the following descriptions and drawings, and from the claims appended below.

DESCRIPTION OF THE PREFERRED EMBODIMENT

Figure 1:
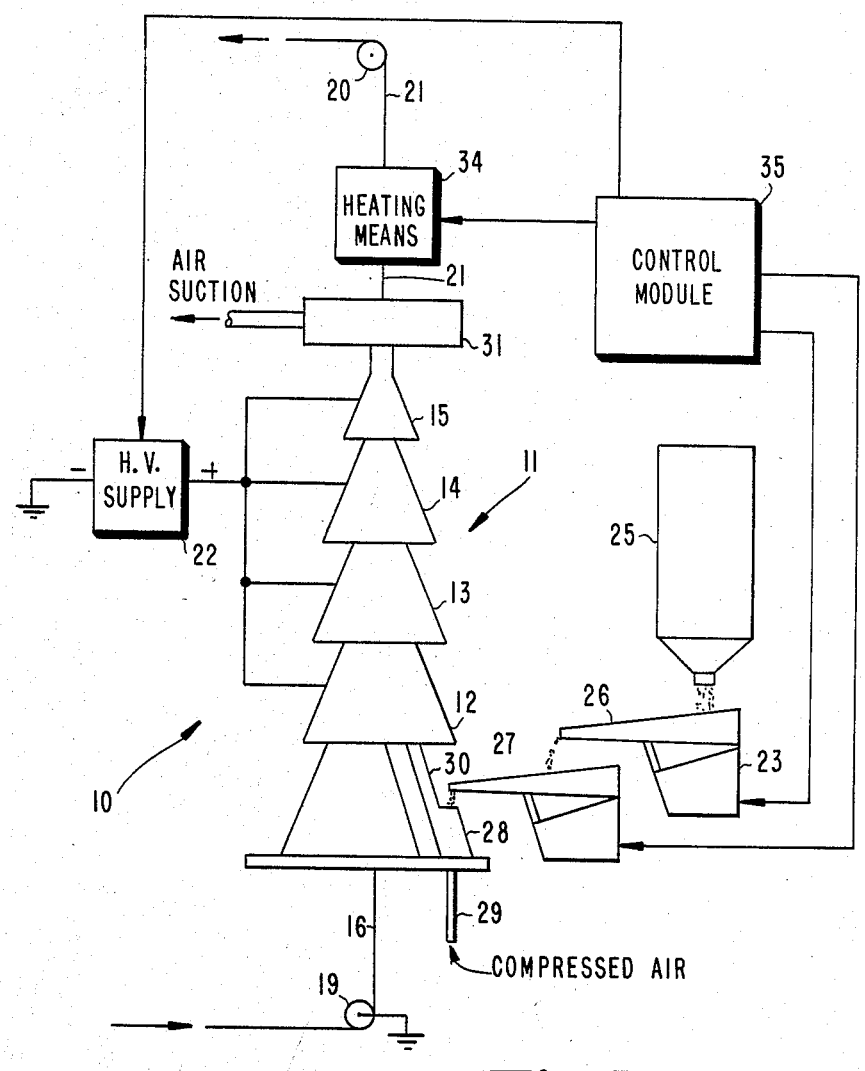
FIG. 1 is a schematic drawing showing an electrostatic filament coater in accordance with the present invention.

For the purposes of promoting an understanding of the present invention, reference will now be made to the embodiment illustrated in the drawings and specific language will be used to describe the same. It is nevertheless to be understood that no limitation of the scope of the invention is thereby intended, the proper scope of the invention being indicated by the claims appended below and the equivalents thereof.

Referring in particular to FIG. 1, there is illustrated the scheme of an electrostatic wire coater 10 comprising the preferred embodiment of the present invention. The principal component of wire coater 10 is coating column 11 including cones 12, 13, 14 and 15, which will be described in greater detail below. Passing upwardly through coating column 11 is filament 16 which is an electrically conductive wire or other elongate filament which is to be coated by wire coater 10. Inasmuch as one of the objects of the present invention is to coat filament 16 on a continuous basis, filament 16 is shown supported below and above coating column 11 by pulleys 19 and 20, it being understood that uncoated filament 16 is transported to pulley 19 from a spool or other source not shown, and that coated filament 21 emerging from the top of wire coater 10 passes over pulley 20 and is then collected on another spool or otherwise treated as desired. Not shown but inherent to the scheme of wire coater 10 is a means for driving and tensioning filament 16 and controlling its speed. Filament 16 is electrically grounded at pulley 19.

Figure 3:
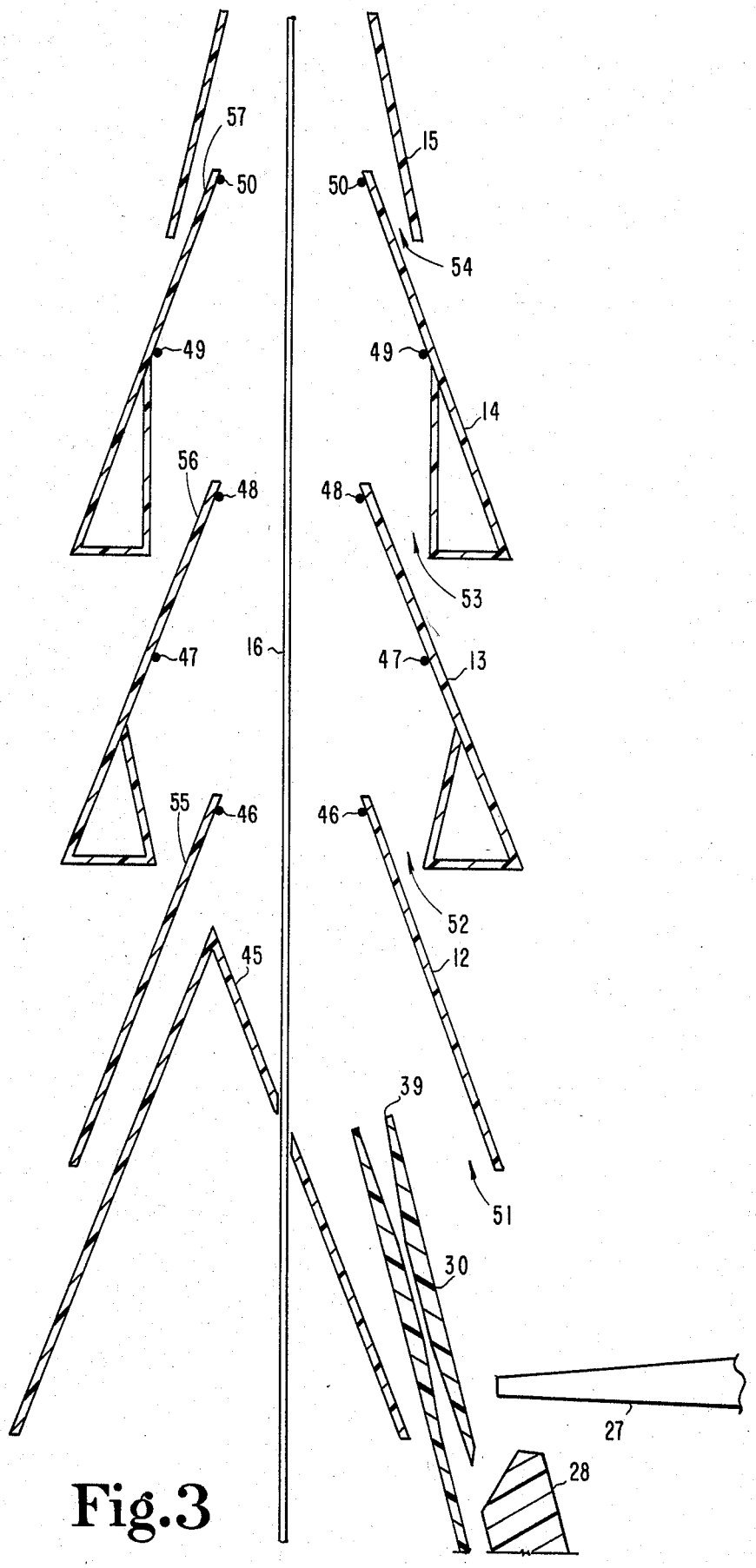
FIG. 3 is a cross-sectional elevational view of the coating column of the filament coater of FIG. 1.

Another element of wire coater 10 is high voltage supply 22 which is connected to fine wire hoop electrodes 46–50 located circumferentially within each of cones 12–15, and shown in FIG. 3. High voltage DC supply 22 impresses high voltage on the electrodes of column 11 causing a strong electrostatic field to exist between the electrodes and grounded filament 16.

The particulate material which is to be coated onto filament 16 is delivered from reservoir 25 at a controlled rate into vibrating trough 26. Trough 26 is made to vibrate by a reciprocating electric solenoid 23 attached thereto. Solenoid 23 is activated by an electrical signal having a waveform which results from rectification of a sinusoidal signal by means of a silicon controlled rectifier, with the triggering level being adjustable to control the amplitude of the vibration. Such a wave form is characterized by a fast rising leading edge and a sinusoidally falling trailing edge. The resulting vibration breaks up clumps of agglomerated particles and causes particles to migrate along trough 26 toward the open end where they fall into a second vibrating trough 27. Vibrating trough 27, similar in structure and operation to trough 26, further breaks up agglomerations of particles and acts as a buffer to spread out the particles along its length and deliver a smooth and constant flow of finely divided particles to column 11 regardless of the presence of minor fluctuations of flow from trough 26.

Figure 2:
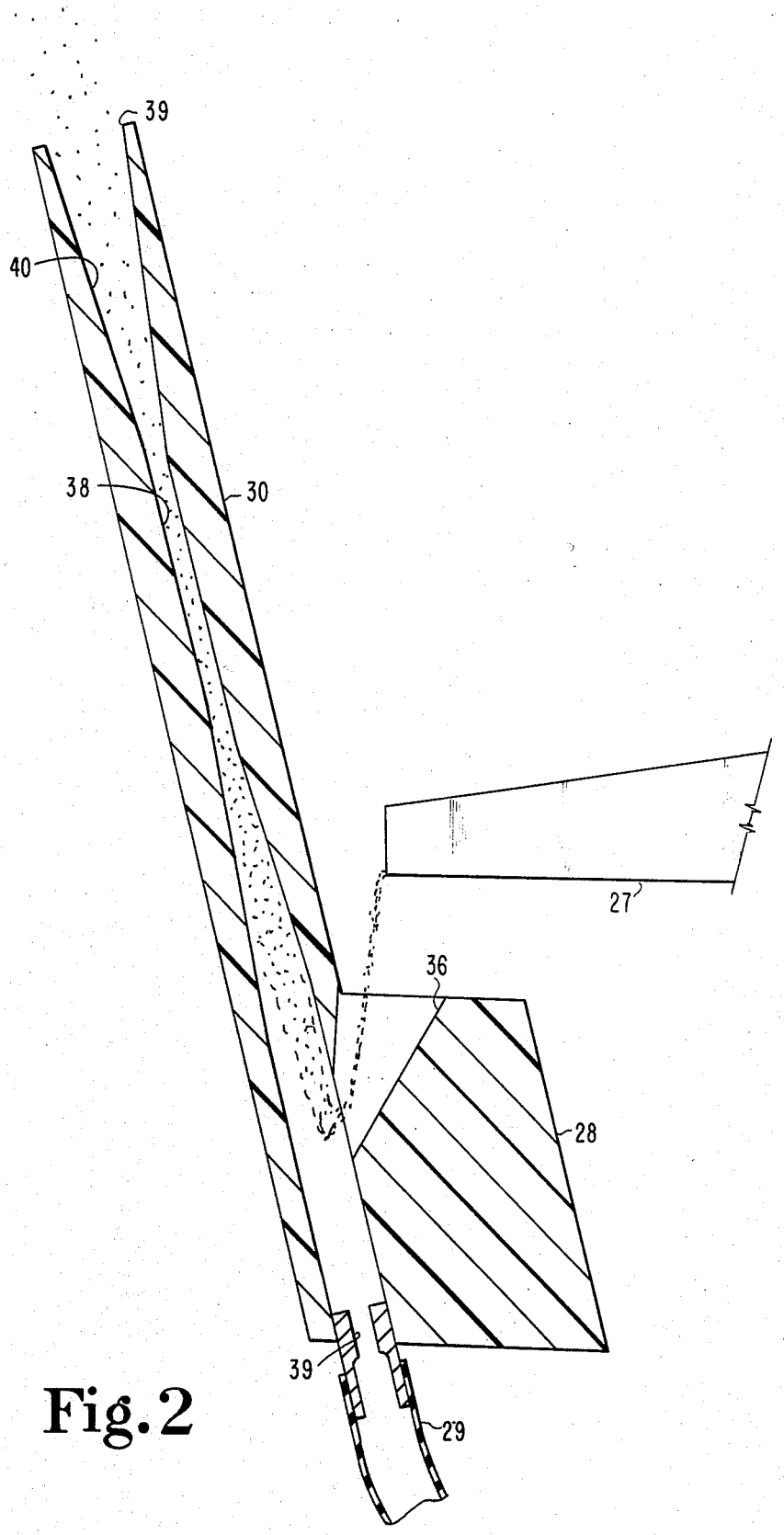
FIG. 2 is a cross-sectional elevational view of the powder injector nozzle of the filament coater of FIG. 1.

Referring now to FIG. 2, the unagglomerated particles from the open end of trough 27 fall by gravity into opening 36 of particle injector 28, whereupon they are turned upward and accelerated by gas flow from orifice 37. The particulate then enters converging-constant section-diverging nozzle 30. Due to the presence of aerodynamic drag from the wall 38, as well as shock waves if sufficient pressure is used in orifice 37, a considerable variation in local velocity occurs across the flow during its movement through nozzle 30. The variation in local total pressure, or velocity pressure, is sufficient to break up remaining agglomerates of particles, plus further shear the particulates into generally finer form as they traverse nozzle 30. Powder exiting the nozzle at end 39 is decelerated from maximum speed due to the divergent geometry of passage 40.

Referring now to FIG. 3, material exiting the nozzle at 39 continues to decelerate in a free jet expansion, loosely confined by the geometry of the outer form of cone 45, and the inner geometry of cone 12. Deceleration from the high velocities necessary for the particle size reduction, to those where electrostatic forces can predominate, is required for good material deposition onto the target filament 16. Moving upwards while decelerating, the particulate enters a region of high corona discharge imposed by electrode 46, on which a near arc-over voltage is impressed by high voltage power supply 22. By conventional electrostatic means, the particulate becomes charged by bombardment and diffusion and is driven towards the target filament held at ground potential by grounded pulley 19. The convergent interior geometry of cone 12 also provides a net velocity vector of the airborne particulate towards the target filament 16. Such particulate that escapes charge in cone 12, passes upward into cone 13. Two high potential electrodes 47 and 48 are located within cone 13. Again, a convergent geometry of cone 13 provides a particulate velocity vector towards the filament 16, aiding in deposition due to increasing both the concentration of particulate and the horizontal velocity vector acquired additive to that the particles acquire after becoming charged. At this point in the process, a good deal of the filament 16 has become coated due to the preceding section 12. Since the particulates are of a highly resistive nature, with long relaxation times, they continue to maintain their surface charge as the filament 16 moves upward. This not only provides means for the powder to remain affixed to the filament, but also provides a field opposing further deposition of powder on that spot. Thus, the powder forced toward the filament under the action of cone 13 is caused to seek out uncoated areas where no opposing charge exists. Any number of stages can be added to the apparatus, in the manner of cones 14 and 15, with their electrodes 49 and 50. Material that is difficult to charge due to low resistivity may require more stages than that of high resistivity.

The upward flow of gas and particulates ejected from nozzle 30 tends to cause air to be drawn in through openings at the lower ends of the cones, such as at openings 51–54, which assists in the convergence of the particulate on the filament 16. However, this airflow is so slight as not to prevent oversprayed material from exiting the cones on the surfaces 55, 56, and 57. This material will accumulate there until it avalanches off, where it can be recovered and reused, if desired. This action on the outside of the cones is significant as it prevents sudden unwanted discharges of heavily concentrated particulates from entering the corona zones, thus potentially becoming charged and deposited onto filament 16, causing a momentary portion of increased material deposition inconsistent with the quality required of this process.

Referring once again to FIG. 1, the upward flow of air provided by particle injector 28 in most cases will provide enough upward draft within column 11 to enable the benefits associated with the unique geometry of column 11 to be realized. However, the upward draft can be enhanced if desired by applying suction to the top of column 11 via plenum 31. The exhaust from plenum 31 can be directed to conventional dust collection means for particulate emission control purposes and for recovery of undeposited particles for reuse, although it should be noted that when the transport rate of filament 16 and the flow rate of the particles into column 11 is properly adjusted, there is very little particle exhaust into plenum 31.

After emerging from the top of column 11, coated filament 21 passes through heating means 34 where the particulate coating can be heated to cause it to fuse into a smooth continuous coating. It has been found that infra-red heating is the most effective in causing even melting and flow of the particles.

Control module 35 provides control for vibrating troughs 26 and 27, heating means 34 and high voltage supply 22. While not shown, control module 35 could also be linked to the compressed air supply, the air suction supply of plenum 31, and the drive means for filament 16. Control module 35 is in essence a convenient collection of controls for enabling an operator to adjust each of the input variables which affect the operation of wire coater 10. Deposition thickness control is effected by controlling the inputs of both wire and powder to the device, relying on the reasonably fixed deposition efficiency of the apparatus to maintain desired film thickness. If desired, the control could be automated with the emerging wire being monitored for dimensional or other characteristics and adjustments made automatically in response to such monitoring.

Decorative coatings can often be applied as thinner films, still maintaining required properties provided the coating apparatus has the inherent control and consistency of operation. This apparatus has both such features, and would serve to produce cost savings for much of the decorative market's coating needs.

Typical applications of this machine in the wire field might include magnet wire for electrical applications, structural cable, coated in either prewound strand form, or coated as a wound cable. Decorative wire used in such applications as furniture and coat hangers can also be coated.

End applications for articles such as magnet wire benefit from thinner insulative coatings. This is due to increasing the magnetic flux density because cores of transformers and coils can be wound more tightly.

But this invention is not limited to metallic wires. Filaments including fiber optic cable can be coated with opaque coatings to improve their internal transmission ability. Hot glass forms a suitably conductive filament.

Additionally, in the textile field, synthetics are often overcoated with natural fibers, for example, polyester is mercerized with cotton to provide comfort qualities desirable in clothing. Apparatus that exist now include electrostatic means for attracting the short cotton fibers to the polyester filament. These machines, as is known, run into problems with undeposited material accumulating in the coating chamber to some point and then falling into the electrostatic field and forming a heavy deposition on the filament, resulting in subsequent handling problems of the material. Inherent in the object of the present invention is a geometric arrangement which exhausts undeposited material outside of the coating region, and prevents it from reentering. Consequently, this machine could potentially have advantages over existing equipment known in the textile field.

Uses incidental to coating are also potential. For example, the apparatus could be used as a precipitator for particulate. The wire could be put onto a closed loop form and recirculated through the apparatus, picking up particulate on each pass, then wiped clean upon its exit from the chamber. In this manner, for example, problems inherent in precipitator plate rapping could be eliminated.

Since it is possible to coat wire with diameters as large as ¼ inch diameter, a reciprocating rod of this size could be used in place of a recirculating wire in the precipitator if additional ruggedness of the collection element would prove necessary.

It is envisioned that the embodiment shown herein could be modified to coat conductive substrates other than a single wire, such as a plurality of parallel wires, or thin strips, or wide sheet material. Such modification might require cones with eliptical, rectangular, or other cross-sectional shapes to accommodate the geometry of the conductive substrate which is to be coated. Furthermore, additional particle injectors could be provided to insure even coating of all surfaces of strip and sheet substrates.

Although many uses for the present invention are envisioned, the preferred use as shown by the embodiment illustrated herein is the coating of copper wire with a synthetic resin. Good results have been achieved using a red epoxy powder, product number E31808-5N, sold by Morton Thiokol, Inc., P.O. Box 647, Warsaw, Ind. 46580.

While the preferred embodiment of the invention has been illustrated and described in some detail in the drawings and foregoing description, it is to be understood that this description is made only by way of example to set forth the best mode contemplated of carrying out the invention and not as a limitation to the scope of the invention which is pointed out in the claims below.

What is claimed is:

1. An electrostatic filament coater, comprising:

a coating column including a plurality of electrically non-conductive hollow cones stacked vertically in spaced relationship, each of the hollow cones being open at bottom and top and converging inwardly from bottom to top, said plurality of hollow cones defining a vertically oriented coating chamber therethrough and a plurality of annular-conical spaces therebetween, the annular-conical spaces communicating the coating chamber with the exterior of the column;

an elongate electrically conductive filament oriented vertically and located within said coating chamber;

transport means for transporting said filament upwardly through and out of said coating chamber;

a plurality of vertically spaced electrodes located circumferentially about said filament and interiorly of said cones;

voltage means for maintaining a high electrical potential difference between said electrodes and said filament;

powder introducer means for introducing into said coating chamber below the lowest electrode an upwardly flowing current of gas carrying a fine dispersion of said powder.

2. The electrostatic filament coater of claim 1, in which there is a plurality of elongated electrically conductive filaments.

3. The electrostatic filament coater of claim 1, and further including heating means for heating the powder coating on said filament after said filament emerges from the coating chamber.

4. The electrostatic filament coater of claim 3, wherein said heating means heats the powder coating on said filament primarily by infra-red radiation.

5. The electrostatic filament coater of claim 1, wherein said powder introducer means includes a nozzle having an inlet, an upwardly directed outlet, a converging-diverging portion therebetween, and means for introducing into said inlet a current of gas and powder.

6. The electrostatic filament coater of claim 5, wherein said means for introducing a current of gas and powder includes means for producing and directing a jet of gas into said inlet, and means for delivering a stream of finely divided powder into intersection with said jet of gas before said inlet.

7. The electrostatic filament coater of claim 6, and further including means for drawing a current of air upwardly through said coating chamber.

8. The electrostatic filament coater of claim 6, wherein said means for delivering a stream of finely divided powder includes a first vibrating trough for receiving and transporting said powder.

9. The electrostatic filament coater of claim 8, in which said said powder is transported at a preset rate.

10. The electrostatic filament coater of claim 8, and further including a second vibrating trough for receiving, deagglomerating and transporting said powder to said first vibrating trough.

11. A method of coating a filament, comprising the steps of:

(a) providing a coating column including a plurality of electrically non-conductive hollow cones stacked vertically in spaced relationship, each of the hollow cones being open at bottom and top and converging inwardly from bottom to top, said plurality of hollow cones defining a vertically oriented coating chamber therethrough and a plurality of annular-conical spaces therebetween, the annular-conical spaces communicating the coating chamber with the exterior of the column, said coating column including a plurality of vertically spaced electrodes located circumferentially about said filament and interiorly of said cones;

(b) passing an elongate electrically conductive filament oriented vertically upwardly through said coating chamber;

(c) providing and maintaining a high electrical potential difference between said electrodes and said filament; and (d) introducing into said coating chamber below the lowest electrode an upwardly flowing current of gas carrying a fine dispersion of said powder.

* * * * *